US007267166B2

(12) United States Patent
Leterrible et al.

(10) Patent No.: US 7,267,166 B2
(45) Date of Patent: Sep. 11, 2007

(54) GROOVED TUBES FOR HEAT EXCHANGERS THAT USE A SINGLE-PHASE FLUID

(75) Inventors: Pascal Leterrible, Dangu (FR); Guy de Hollain, Vernouillet (FR); Nicolas Avanan, Talmontiers (FR)

(73) Assignee: Trefimetaux S.A., Courbevoie Cedex (FR)

( * ) Notice: Subject to any disclaimer, the term of this patent is extended or adjusted under 35 U.S.C. 154(b) by 625 days.

(21) Appl. No.: 10/853,799

(22) Filed: May 25, 2004

(65) Prior Publication Data

US 2005/0045319 A1 Mar. 3, 2005

(30) Foreign Application Priority Data

May 26, 2003 (FR) ..... 03 06316

(51) Int. Cl.
*F28F 1/00* (2006.01)

(52) U.S. Cl. ..... 165/179; 165/177; 165/DIG. 510; 165/184; 138/38; 29/890.046; 29/890.048

(58) Field of Classification Search ..... 165/179, 165/177, 181, 183, 184, DIG. 510, DIG. 515; 138/156, 38; 29/890.045, 890.046, 890.048
See application file for complete search history.

(56) References Cited

U.S. PATENT DOCUMENTS 4,044,797 A * 8/1977 Fujie et al. ..... 138/38
4,480,684 A * 11/1984 Onishi et al. ..... 165/110
4,545,428 A * 10/1985 Onishi et al. ..... 165/110
4,938,282 A * 7/1990 Zohler ..... 165/133
5,010,643 A * 4/1991 Zohler ..... 29/890.048
5,219,374 A * 6/1993 Keyes ..... 29/890.049
5,259,448 A * 11/1993 Masukawa et al. ..... 165/133
5,628,447 A * 5/1997 Ziemek ..... 228/147
5,690,167 A * 11/1997 Rieger ..... 165/133
5,692,560 A * 12/1997 Messant et al. ..... 165/151
5,704,424 A * 1/1998 Kohno et al. ..... 165/184
5,791,405 A * 8/1998 Takiura et al. ..... 165/184
5,934,128 A * 8/1999 Takiura et al. ..... 72/197
6,018,963 A * 2/2000 Itoh et al. ..... 62/527

(Continued)

FOREIGN PATENT DOCUMENTS

EP 0148609 * 7/1985

(Continued)

*Primary Examiner*—Ljiljana Ciric
(74) *Attorney, Agent, or Firm*—Kenyon & Kenyon LLP

(57) ABSTRACT

Grooved metal tubes, with a groove-bottom thickness $T_f$ and outside diameter De, internally grooved with N helical ribs having an apex angle α, height H, base width $L_N$, and helix angle β, two consecutive ribs being separated by a groove, generally flat-bottomed, having a width $L_R$, with a pitch P equal to $L_R+L_N$, are characterized in that:

a) the thickness $T_f$ of the tube is such that $T_f$/De is equal to 0.023±0.005, $T_f$ and De being expressed in mm, with De ranging between 4 and 14.5 mm;

b) the ribs have a height H such that H/De is equal to 0.028±0.005, H and De being expressed in mm;

c) the number N of ribs is such that N/De is equal to 2.1±0.4, and the corresponding pitch P is equal to p·Di/N, with Di equal to De−2·$T_f$, and De being expressed in mm;

d) the base widths $L_N$ and $L_R$ are such that $L_N/L_R$ is between 0.20 and 0.80;

e) the apex angle α ranges from 10° to 50°; and f) the helix angle β ranges from 20° to 50°.

20 Claims, 7 Drawing Sheets

U.S. PATENT DOCUMENTS 6,662,860 B2 * 12/2003 Iwamoto et al. ..... 165/133
7,048,043 B2 * 5/2006 Leterrible et al. ..... 165/184

FOREIGN PATENT DOCUMENTS

EP 701-680 * 3/1996
JP 52-38663 * 3/1977
JP 55-18018 * 2/1980
JP 57-58088 * 4/1982
JP 57-58094 * 4/1982
JP 62-25959 * 2/1987

* cited by examiner

GROOVED TUBES FOR HEAT EXCHANGERS THAT USE A SINGLE-PHASE FLUID

FIELD OF THE INVENTION

The invention relates to the field of heat exchanger tubes, and more specifically the field of heat exchanger-tubes using a "single-phase" fluid, i.e., a fluid for which the heat exchange does not include an evaporation and condensation cycle, "two-phase" fluids being those that use the latent heat from vaporization and condensation.

BACKGROUND INFORMATION

A large number of documents describing the geometry of grooved tubes used in heat exchangers are known.

European Patent Application EP-A2-0 148 609 describes triangular or trapezoidal grooved tubes having the following characteristics:

- an H/Di ratio between 0.02 and 0.03, where H designates the depth of the grooves (or height of the ribs), and Di the inside diameter of the grooved tube,
- a helix angle β with reference to the tube axis between 7 and 30°,
- an S/H ratio between 0.15 and 0.40, where S designates the cross-section of the groove, and
- an apex angle α of the ribs between 30 and 60°0.

These tube characteristics are suitable for phase change fluids, the tube performances being analyzed discretely when the fluid evaporates or condenses.

Japanese Patent Application No. 57-580088 describes tubes with V-shaped grooves, with H between 0.02 and 0.2 mm and an angle β between 4 and 15°. Similar tubes are described in Japanese Application No. 57-58094.

Japanese Patent Application No. 52-38663 describes tubes with V- or U-shaped grooves, with H between 0.02 and 0.2 mm, a pitch P between 0.1 and 0.5 mm, and an angle β between 4 and 15°.

U.S. Pat. No. 4,044,797 describes tubes with V- or U-shaped grooves similar to the aforementioned tubes.

Japanese Utility Model No. 55-180186 describes tubes with trapezoidal grooves and triangular ribs, with a height H of 0.15 to 0.25 mm, a pitch P of 0.56 mm, an apex angle a (referred to as angle θ in that document) typically equal to 73°, an angle β of 30°, and a mean thickness of 0.44 mm.

U.S. Pat. No. 4,545,428 and No. 4,480,684 describe tubes with V-shaped grooves and triangular ribs, with a height H between 0.1 and 0.6 mm, a pitch P between 0.2 and 0.6 mm, an apex angle α between 50 and 100°, and a helix angle β between 16 and 35°.

Japanese Patent No. 62-25959 describes tubes with trapezoidal grooves and ribs, with a groove depth H between 0.2 and 0.5 mm and a pitch P between 0.3 and 1.5 mm, the mean groove width being at least equal to the mean rib width. In one example, the pitch P is 0.70 and the helix angle β is 10°.

Finally, European Patent No. EP-B1-701 680, held by the applicant, describes grooved tubes, with flat-bottomed grooves and ribs of a different height H, a helix angle β between 5 and 50°, and an apex angle α between 30 and 60°, to ensure improved performance after the tubes are crimped and mounted in the exchangers.

In general, the technical and economic performance of the tubes, which results from the combination of tube specifications adopted (H, P, α, β, shape of grooves and ribs, etc.), generally arises from four considerations:

- the characteristics relating to heat transfer (heat exchange coefficient), an area in which grooved tubes are greatly superior to non-grooved tubes, such that, for an equivalent heat exchange, the necessary length of a-grooved tube will be less than that of a non-grooved tube,
- the characteristics relating to head loss, since minor head losses make it possible to use pumps or compressors of lower power, size and cost,
- the industrial feasibility of the tubes and production speed, which determines the cost price of the tube for the tube manufacturer,
- finally, the characteristics relating to the mechanical properties of the tubes, typically related to the type of alloys used or the mean tube thickness, which determines the weight of the tube per unit of length, and, therefore, influences its cost price.

There are several problems with current designs.

Firstly, there are a great number and very wide variety of potential models with respect to grooved tubes, given that they generally aim to optimize heat exchange and decrease head loss.

Secondly, each of these models usually offers a wide range of possibilities, the parameters being generally defined by relatively broad ranges of values.

Finally, these models, when specified, relate to exchanges with two-phase fluids, i.e., those that use a fluid that evaporates in one part of the fluid circuit within the exchanger and condenses in another part of the circuit; no one grooved tube is used for both evaporation and condensation. Consequently, a person skilled in the art already has great difficulty determining the quintessential state of the art from such a large amount of data, which are sometimes contradictory.

A person skilled in the art knows that a typical commercially available tube, with triangular ribs as illustrated in FIG. 1, typically has the following characteristics: outside diameter De=12 mm, rib height H=0.25 mm, tube wall thickness $T_f$=0.35 mm, number of ribs N=65, helix angle β=18°, apex angle α=55°.

SUMMARY

The present invention relates to tubes or exchangers in the field of single-phase fluids and used for reversible applications, i.e., tubes or exchangers that may be used with water or glycol water as a refrigerant or coolant fluid, typically either to cool the air in air-conditioning exchangers or to heat the air in such exchangers.

Therefore, the applicant researched and developed tubes and exchangers that are economical and at the same time have a relatively low weight per meter, a high level of heat exchange performance, and a low level of head loss, for applications or fields that use single-phase fluids.

According to the present invention, the grooved metal tubes, with a groove-bottom thickness $T_f$ and outside diameter De, typically intended for the manufacture of heat exchangers using a single-phase refrigerant or coolant fluid, internally grooved with N helical ribs having an apex angle α, height H, base width $L_N$, and helix angle β, two consecutive ribs being separated by a groove, generally flat-bottomed, having a width $L_R$, with a pitch P equal to $L_R+L_N$, are characterized in that:

a) the thickness $T_f$ of the tube is such that $T_f$/De is equal to 0.023±0.005, $T_f$ and De being expressed in mm, with De ranging between 4 and 14.5 mm;

b) the ribs have a height H such that H/De is equal to 0.028±0.005, H and De being expressed in mm;

c) the number N of ribs is such that N/De is equal to 2.1±0.4, and the corresponding pitch P is equal to $\pi \cdot Di/N$, with Di equal to $De-2 \cdot T_f$, and De being expressed in mm;

d) the base widths $L_N$ and $L_R$ are such that $L_N/L_R$ is between 0.20 and 0.80;

e) the apex angle α ranges from 10° to 50°; and f) said helix angle β ranges from 20° to 50°;

so that a typically single-phase fluid, typically including water or glycol water, can be used as a refrigerant or coolant fluid to ensure simultaneously a high heat exchange coefficient during heating and cooling, a low level of head loss, and a low weight/meter.

In effect, by studying heat exchanger systems that use a single-phase fluid in comparison to systems using a two-phase fluid in which the part of the system related to the hot source is the center of evaporation, while the part of the system related to the cold source is the center of condensation, the applicant found that the grooved tubes that ensure high performance when used with a two-phase fluid were not appropriate for single-phase fluids.

The applicant succeeded in creating tubes that are appropriate for single-phase fluids and at the same time generate little low head loss and have a low weight per meter, using a combination of the above characteristics a) through f).

In particular, contrary to the conclusions of the prevailing state of the art, these tubes have both a small number of ribs and a relatively low thickness.

BRIEF DESCRIPTION OF THE DRAWINGS

The different parameters used to specify the tubes according to the invention are shown in FIGS. 1*a* and 1*c*, to illustrate their meaning.

(FIG. 4*a*) and −5° C. (FIG. 4*b*), respectively.

DETAILED DESCRIPTION

Figure 1A:
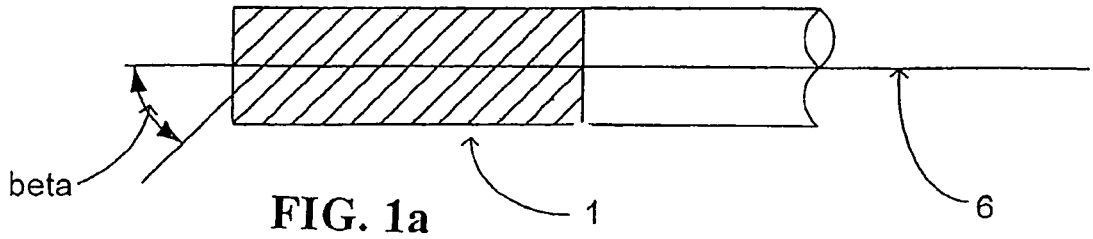
FIG. 1*a* is a partial view of a grooved tube (1), in a partial cross-section along the tube axis, illustrating the helix angle β.
Figure 1B:
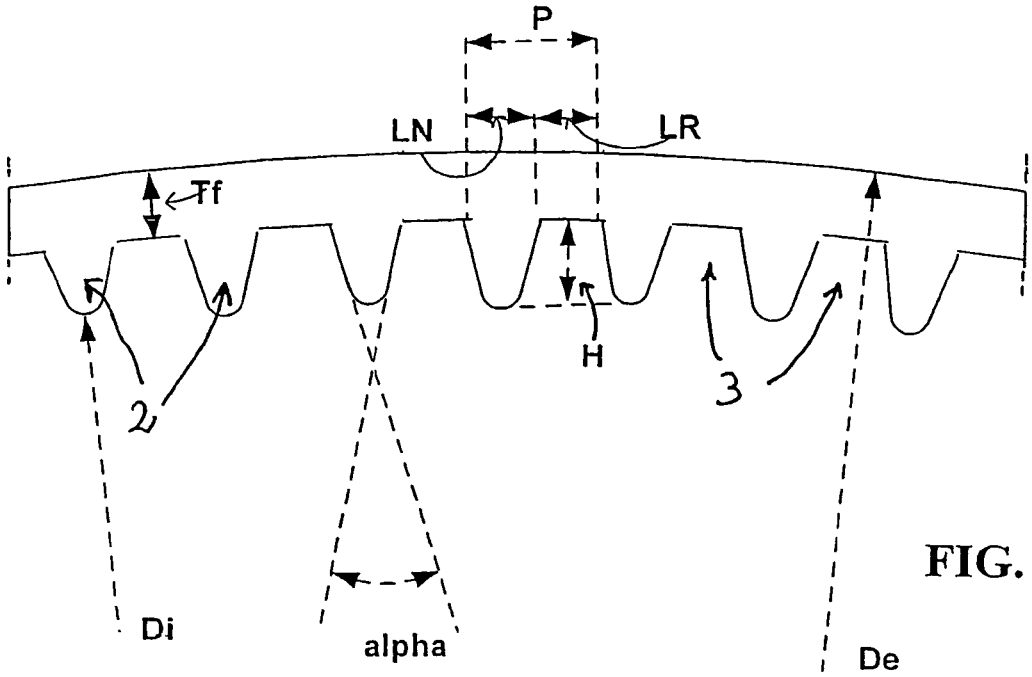
FIG. 1*b* is a partial view of a grooved tube (1), in a partial cross-section perpendicular to the tube axis, illustrating the case of a tube comprising a succession of ribs (2) with a height H, the ribs being roughly triangular in shape and having a width $L_N$ at the base and an apex angle α, separated by grooves (3) that are roughly trapezoidal in shape and having a width $L_R$, $L_R$ being the distance between two rib grooves. The tube has a thickness $T_f$, an outside diameter De, an inside diameter Di, and a pitch P equal to $L_R+L_N$.

According to the invention, the helix angle β may fall within the range of 25° to 35°. This is what provides a high exchange coefficient Hi and ensures that the grooving of a tube is appropriate for manufacturing purposes, since the exchange coefficient Hi markedly decreases at lower helix angle β values and the production speed decreases at higher helix angle β values.

According to the invention, the apex angle α may typically be less than 45° and may be, for example, between 15 and 30°.

At higher apex angle α values, the exchange coefficient Hi tends to decrease, and at lower values, there are manufacturing problems, particularly due to the wear of tools and master mandrels; in addition, acute angles tend to be destroyed during manufacture of a battery of tubes with fins as the tubes expand.

With respect particularly to the exchange coefficient Hi, it was found advantageous for the S/H ratio (S being the surface between two consecutive grooves) to be between 0.8 mm and 1.5 mm, S and H being expressed in sq·mm and mm, respectively.

The H/De ratio may be equal to 0.028±0.3. As mentioned above, in order to achieve a high exchange coefficient Hi, it is advantageous to have ribs that are fairly high but not too high, so that the ribs are easy to manufacture and relatively insensitive to tube expansion during manufacture of a battery of tubes with fins.

As is apparent in light of the tests conducted, the P/H ratio may range from 3.5 to 7, but the best results are obtained when that ratio is, for example, from 4 to 6 (see Test A, for example), and, in particular, with relatively high H values of at least 0.30 mm.

According to the invention, the ribs may have a triangular, trapezoidal, or quadrilateral cross-section, possibly with rounded angles at the top.

Figure 2A:
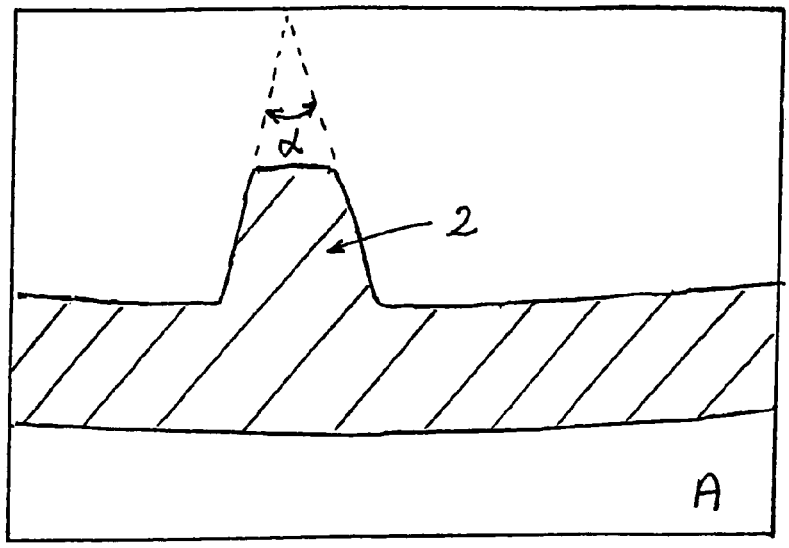
FIG. 2*a*, similar to FIGS. 1*b* and 1*c*, shows a rib (2) of the tube according to Test A.
Figure 2B:
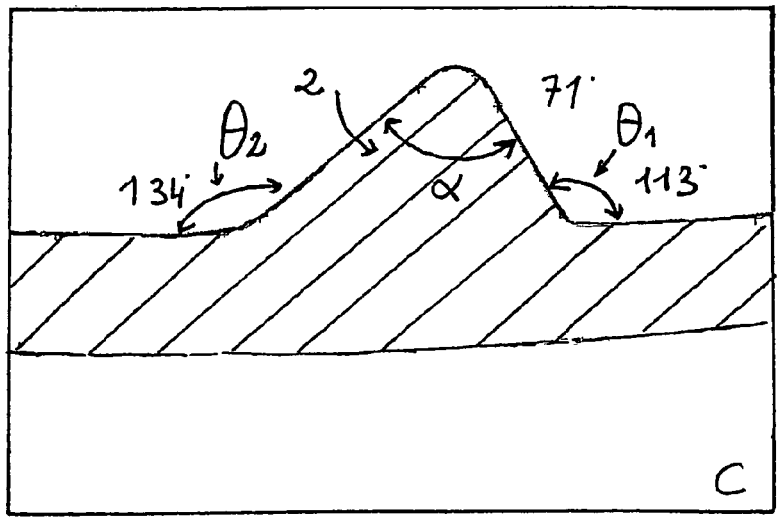
FIG. 2*b*, similar to FIG. 2*a*, shows a rib (2) of the tube according to Test C.
Figure 2C:
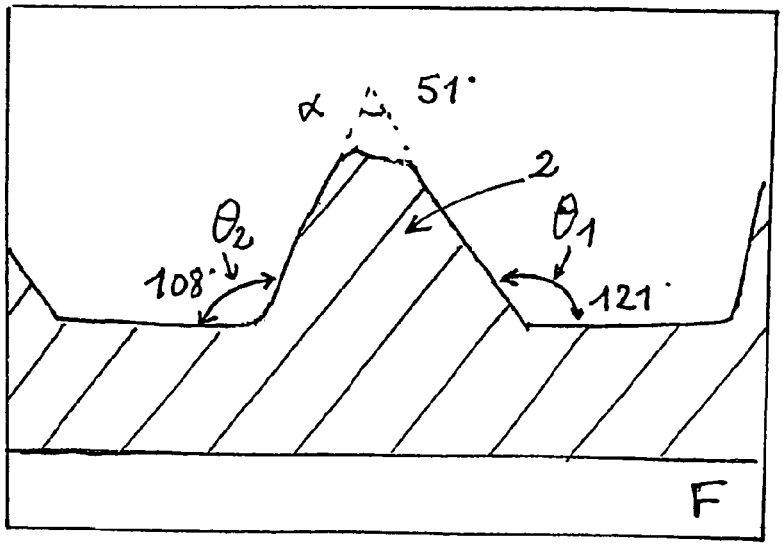
FIG. 2*c*, similar to FIG. 2*a*, shows a rib (2) of the tube according to Test F.

As illustrated in FIG. 2*a*, the ribs may have a trapezoidal profile with a base and a top, the top comprising a roughly flat central part, possibly sloped relative to said base, as illustrated in FIG. 2*c*.

Particularly when the profile of the ribs forms a trapezoid, the top of the rib, which forms a small side of the trapezoid, may have rounded edges, as is often the case when the profile of the ribs forms a triangle.

Thus, the rounded top and/or rounded edges may have a radius of curvature of less than 100 μm, with the connection of the ribs to the typically flat bottoms having a radius of curvature of less than 100 μm, such as ranging from 20 to 50 μm.

The rounded top and/or rounded edges may have a radius of curvature such as less than 80 μm, the radius typically ranging from 40 μm to 80 μm.

Figure 3A:
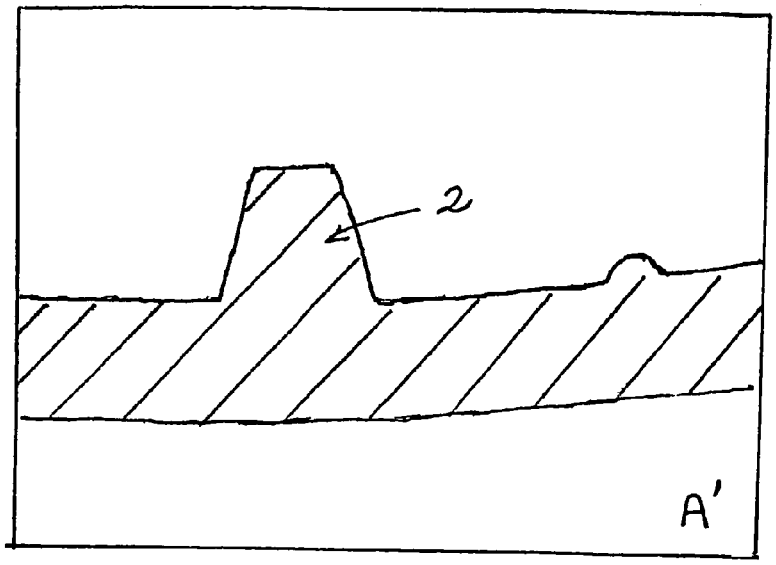
FIG. 3*a*, similar to FIG. 2*a*, shows a rib (2) of the tube according to Test A', which is similar to A.
Figure 3B:
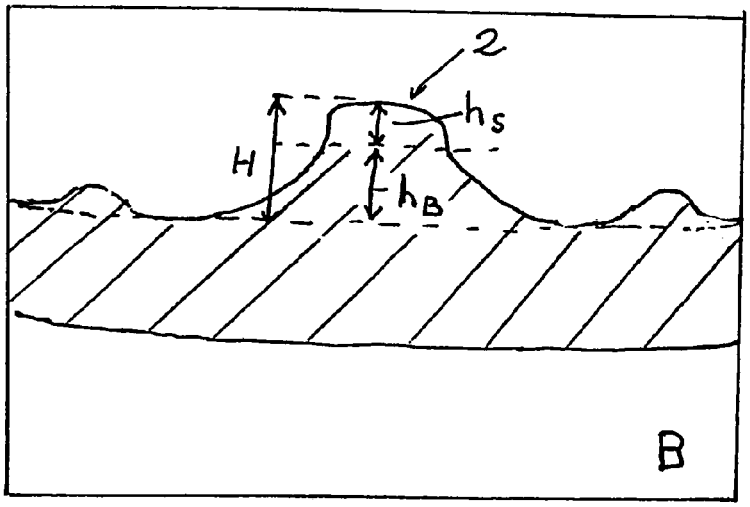
FIG. 3*b*, similar to FIG. 2*a*, shows a rib (2) of the tube according to Test B.

According to an example embodiment of the present invention, as illustrated, for example, in FIGS. 2*a*, 3*a*, or 3*b*, the ribs may be symmetrical and connected to the aforementioned typically flat bottoms with right and left connecting angles $\theta_1$ and $\theta_2$, such that $\theta_1$-$\theta_2$ is typically equal to 0 or, at most, 10°, in order to form symmetrical or nearly symmetrical ribs.

However, as illustrated in FIGS. 2*b* and 2*c*, the ribs may be connected to the aforementioned typically flat bottoms with right and left connecting angles $\theta_1$ and $\theta_2$, such that $\theta_1$-$\theta_2$ is typically at least 10°, in order to form asymmetrical or inclined ribs.

Figure 3C:
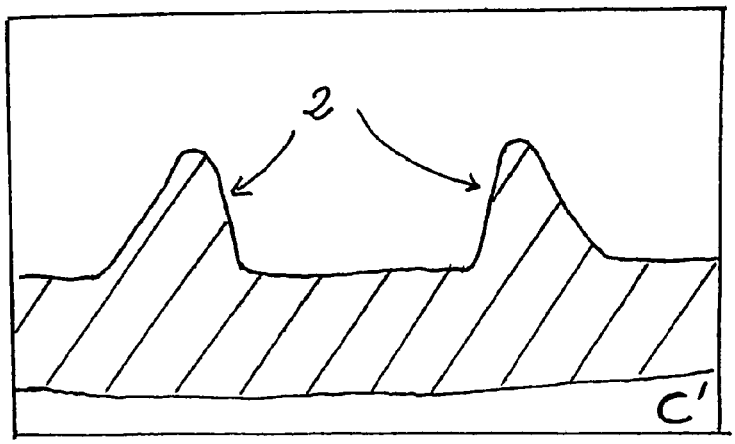
FIG. 3*c*, similar to FIG. 2*b*, is a variant of the latter.

As illustrated in FIG. 3*c*, the ribs may form an alternating succession of ribs, with right and left connecting angles of $\theta_1$ and $\theta_2$ for one and $\theta_2$ and $\theta_1$ for the next.

As illustrated in FIG. 3*b*, the ribs may have a triangular-shaped base with a height $h_B$ and a trapezoidal-shaped top with a height $h_S$, with H equal to $h_B+h_S$ and $h_B/h_S$ ranging typically from 1 to 2.

Figure 1C:
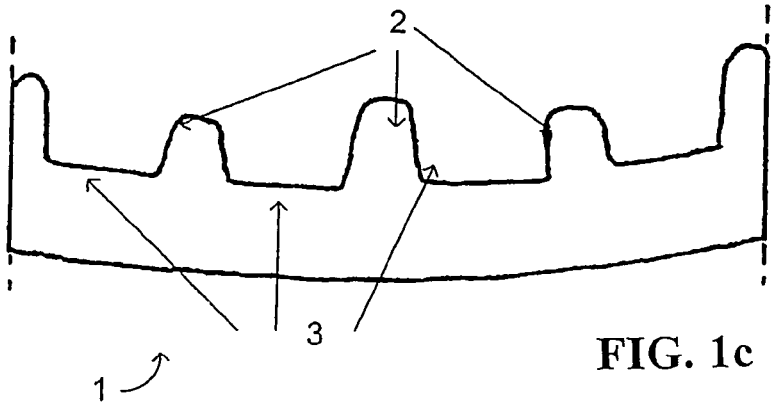
FIG. 1*c* is a partial view of a grooved tube in which the ribs are alternating trapezoidal ribs with a height H1 and a height H2<H1.

As illustrated in FIG. 1*c*, the ribs may form a succession of ribs with a height H1=H and H2=a·H1, with a between 0.1 and 0.9, the rib with a height H1 being the primary rib and the rib with a height H2 being the secondary rib. Typically, the succession may have alternating ribs of height H1 and height H2, separated by a flat-bottomed groove. See Test E with H1=0.25 mm and H2=0.22 mm.

As illustrated in FIGS. 3*a* and 3*b*, the tubes may include secondary ribs with a height H'<0.5·H, typically located halfway between two ribs with a height H or a height H1 and H2.

Figure 4A:
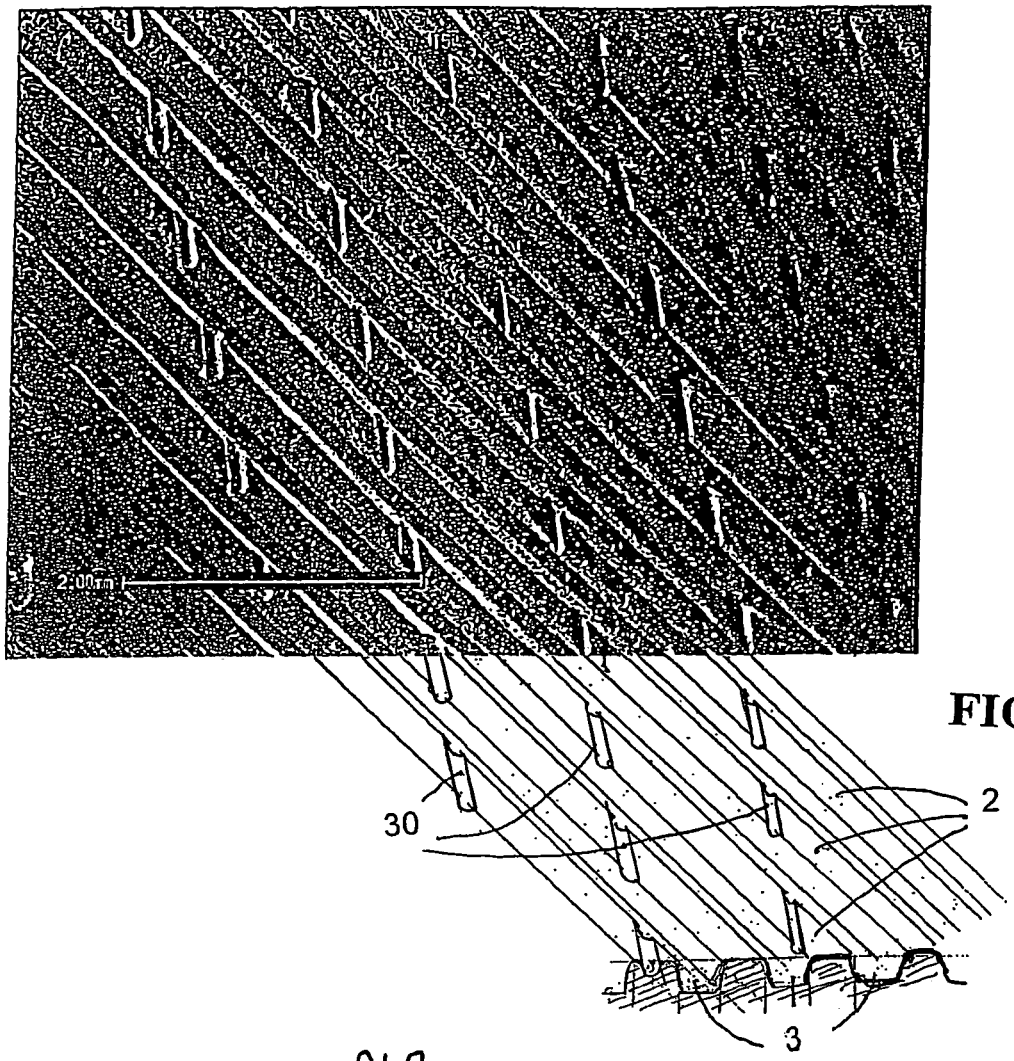
FIG. 4*a* is a view of a portion of the inner surface of a grooved tube according to the invention, equipped with an axial counter-groove (30), illustrated schematically below.

According to the present invention, as illustrated in FIG. 4*a*, the tubes may also include an axially grooved surface creating, in the ribs, notches with a profile that typically is triangular and a rounded top, the top having an angle y ranging from 25 to 65°; this lower part or top lies a distance h from the bottom of said grooves, ranging from 0 to 0.2 mm.

The grooved tubes according to the present invention may be made of Cu and Cu alloys, Al and Al alloys, Fe and Fe alloys.

These tubes, which are typically not fluted, may be made by grooving the tubes or, possibly, by flat-grooving a metal strip and then forming a welded tube.

These tubes may have a round, oval, or rectangular cross-section. They may have an oval or rectangular profile, particularly in the case of welded tubes.

The invention also relates to heat exchangers using tubes according to the present invention.

Figure 4B:
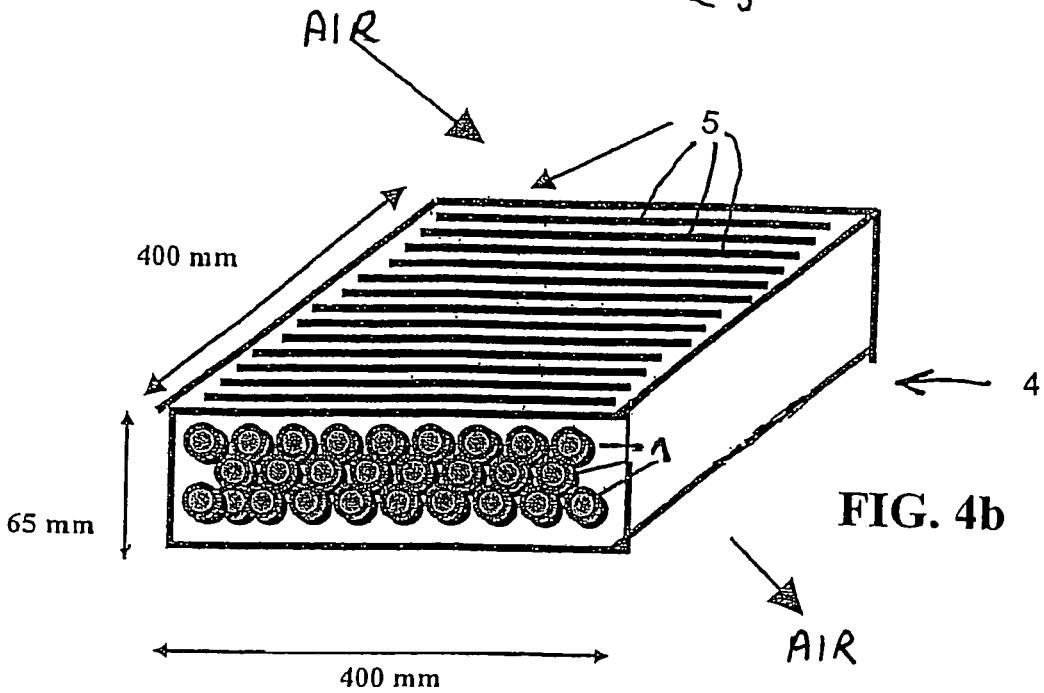
FIG. 4*b* is a schematic perspective view of a battery (4) of tubes (1) with fins (5) used for the tests.
Figure 5A:
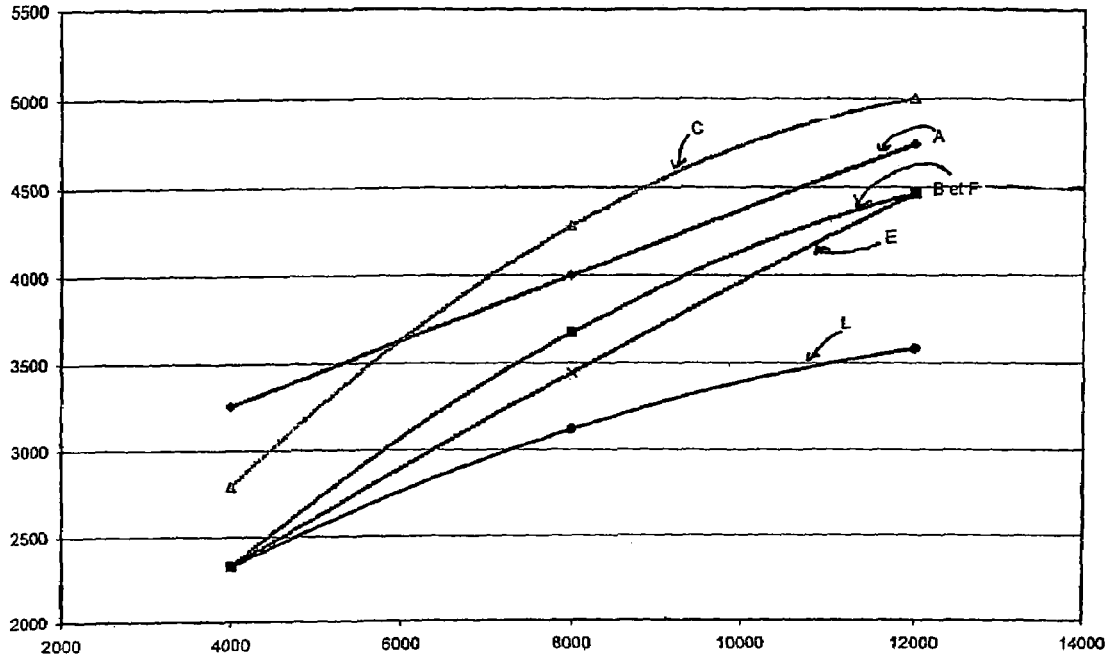
FIGS. 5*a* and 5*b* are graphs indicating the exchange coefficient Hi (in W/sq·m·K) on the ordinate, as a function of the head loss dP in Pa/m on the abscissa, when the refrigerant fluid is an aqueous solution of K formate at +5° C.
Figure 5B:
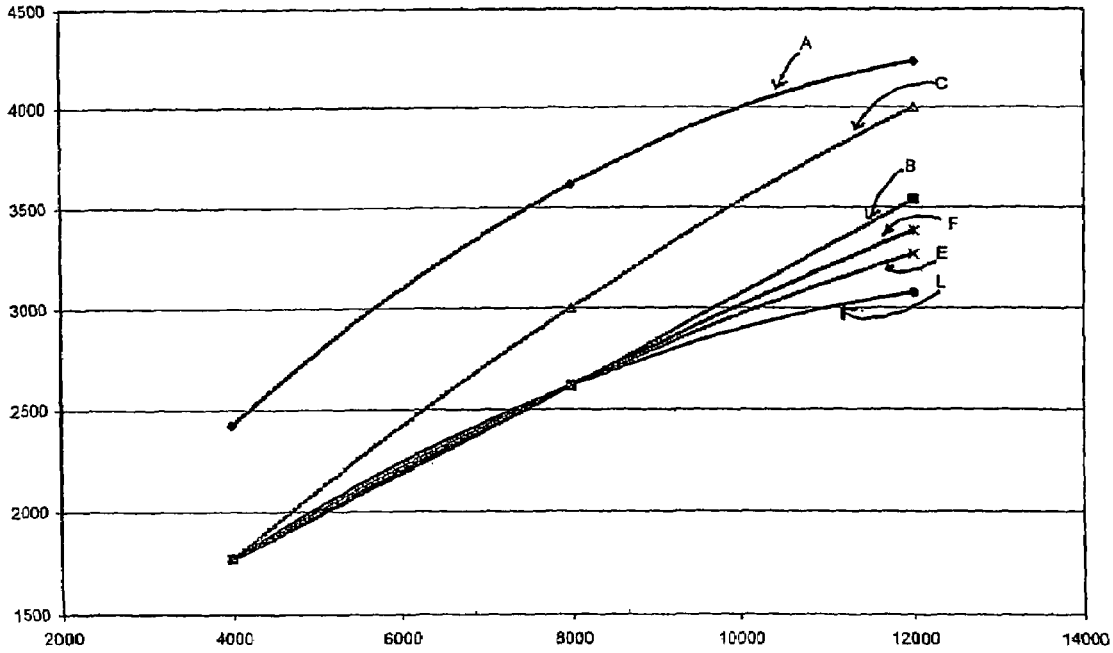
Figure 6A:
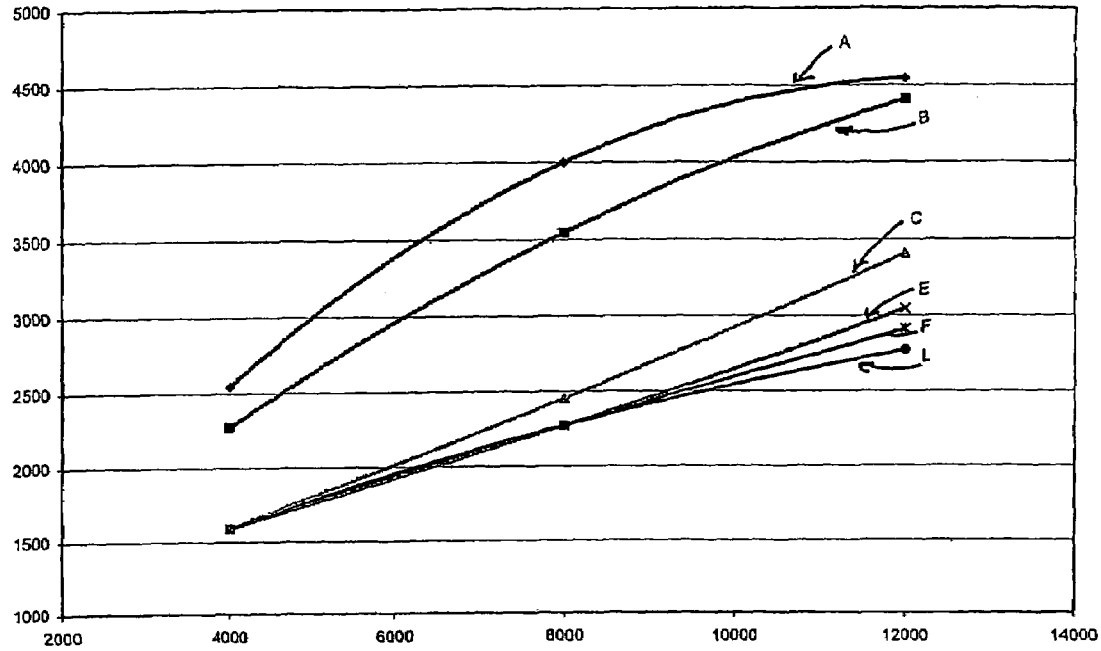
FIGS. 6*a* and 6*b* are views of a portion of the inner surface of a grooved tube and a schematic perspective of a battery of tubes, but when the refrigerant fluid is an aqueous solution of propylene glycol.
Figure 6B:
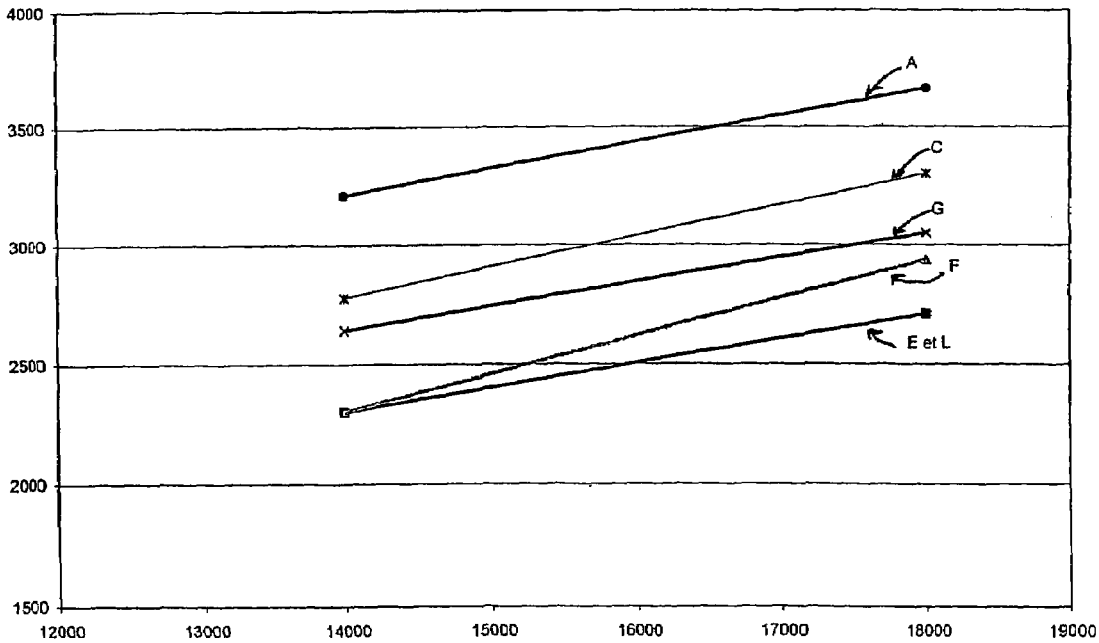
Figure 7A:
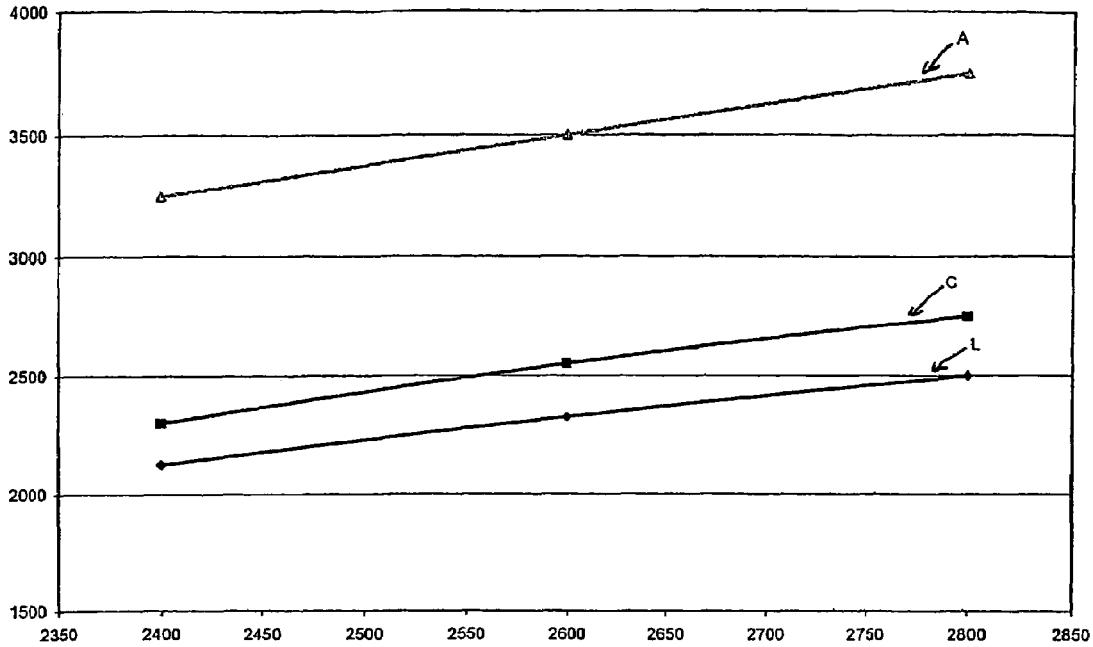
FIG. 7 is a graph indicating the exchange coefficient H1 (in W/sq·m·K) on the ordinate, as a function of the Reynolds on the abscissa, when the refrigerant fluid is an aqueous solution of propylene glycol.
Figure 7B:
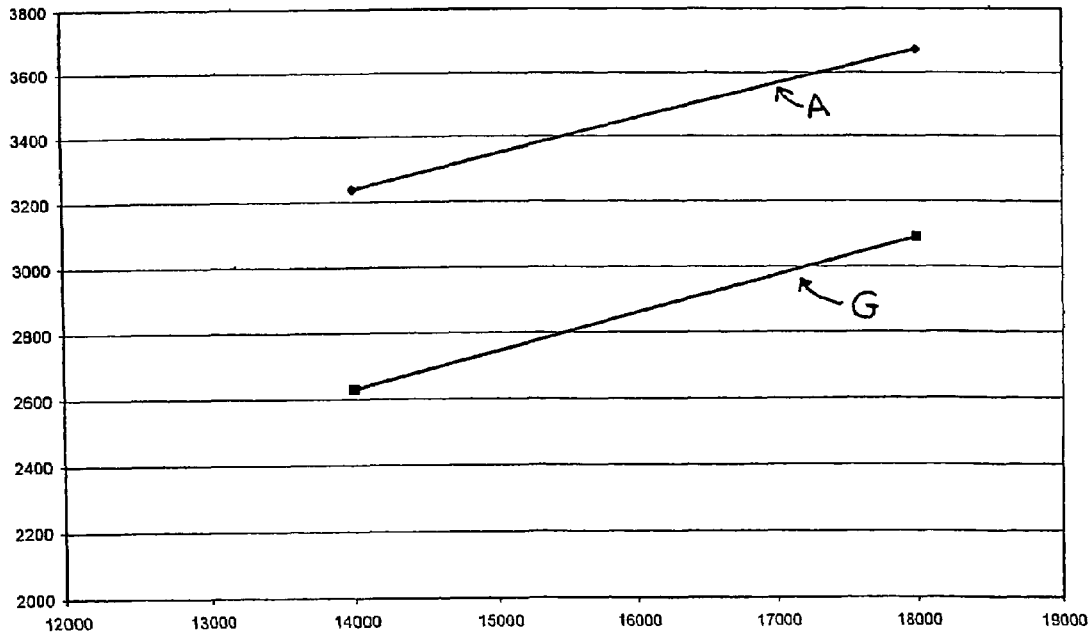

As illustrated in FIG. 4*b*, these exchangers may include heat exchange fins in contact with the tubes along a portion of the tubes; the maximum distance between the fins and the tubes along the portion that is not in contact is less than 0.01 mm, and may be less than 0.005 mm, for example.

The present invention also relates to the use of tubes according to the invention and the use of exchangers according to the present invention, wherein the refrigerant or coolant fluid is used as a single-phase fluid and is typically one of the following: water, aqueous glycol solutions typically containing 30% glycol, solutions of K formate and/or K acetate, slush, organic liquids, or liquid $CO_2$.

According to the present invention, the refrigerant or coolant fluid may be used as a single-phase fluid, typically having a dynamic viscosity between 0.5 and 30 m·Pa and a Prandtl number between 5 and 160.

EXAMPLES OF EMBODIMENTS

A) Tube Manufacture

In the first embodiment grooved copper tubes were manufactured according to the invention with an outside diameter De of 12.0 mm, which were noted as A, B, C, D, and G, as well as control tubes, which were noted as E, F, and G, and a smooth control tube, which was noted L.

Other tests were conducted using other diameters De, which illustrated that the grooving according to the invention made it possible to use a groove-bottom thickness $T_f$ such that $T_f$/De was equal to 0.023±0.005, resulting in a thickness $T_f$ appreciably less than the standard thickness. This yielded a significant weight savings in the tube while still providing satisfactory mechanical performance.

| Tube | H (mm) | Angle α (°) | Angle β (°) | N | Type* | $T_f$ (mm) | $L_N/L_R$ | P/H | P (mm) | S/H |
|---|---|---|---|---|---|---|---|---|---|---|
| A | 0.337 | 29 | 24 | 22 | T1 | 0.30 | 0.28 | 4.84 | 1.63 | 1.36 |
| B | 0.280 | 33 | 25 | 20 | T1-2 | 0.30 | 0.29 | 6.89 | 1.93 | 1.47 |
| C | 0.227 | 70 | 30 | 40 | T2 | 0.30 | 0.77 | 4 | 0.91 | 0.61 |
| D | 0.304 | 41 | 25 | 29 | T1 | 0.32 | 0.51 | 4.12 | 1.25 | 0.85 |
| E | 0.25<br>0.22 | 40 | 18 | 70 | T2 | 0.35 | 1.15 | 2.56 | 0.64 | 0.35 |
| F | 0.23 | 53 | 28 | 65 | T1 | 0.35 | 1.8 | 2.39 | 0.55 | 0.26 |
| G | 0.280 | 70 | 10 | 22 | T1 | 0.30 | 0.28 | 5.80 | 1.62 | 1.36 |
| L | / | / | / | / | | 0.40 | / | / | | / |

*Rib type:
T1 = trapezoid shape,
T2 = triangle shape,
T1-2 combined shape
Note that tubes C and G have non-symmetrical grooves, while the grooves on tubes A, B, D, E, and F are symmetrical.

B) Results

The tubes were tested with two types of single-phase fluid: one was an aqueous solution with 30% monopropylene glycol by volume, and the other was a solution of K formate able to withstand up to −30° C., with a freezing point of −55° C., as opposed to −40° for the monopropylene glycol solution.

The tests were conducted at +5° C. and −5° C.

The dynamic viscosity (m·Pa·s) of the solutions was measured at these two temperatures:

| T | Monopropylene glycol (m · Pa · s) | K formate solution |
|---|---|---|
| −5° C. | 20 | 4.5 |
| +5° C. | 10 | 2.5 |

In addition, the Prandtl number was measured for the monopropylene glycol: 142 at −5° C. and 80 at +5° C.

For the K formate solution, the prandt number was 20 at +5° C.

B1) Weight Per Meter

Tubes A, B, C, D, and G had a weight per meter of 125 g/m, while control tubes E and F, which were grooved tubes of the type used in the current state of the art, had a weight per meter of 140 g/m, while tube L had a weight per meter of 130 g/m.

In conclusion, with the tubes according to the present invention, the weight saved was 10% compared to grooved tubes of the type used in the current state of the art and 4% compared to the smooth tube generally used in this application.

B2) Tests with an Aqueous Solution of 30% Monopropylene Glycol by Volume

1) Tests at −5° C.:

In the case of tubes A, C, and L, the exchange coefficient Hi (W/sq·m·K) was measured as a function of Re, the Reynolds number, for a laminar state in the area of 200<Re<3200.

The following table shows the Hi value for three values of Re: 2400, 2600, and 2800.

| Re | Hi, tube A = HiA | Hi, tube C = HiC | Hi, tube L = HiL | HiA/HiL | HiC/HiL |
|---|---|---|---|---|---|
| 2400 | 3250 | 2300 | 2125 | 1.53 | 1.08 |
| 2600 | 3500 | 2550 | 2325 | 1.50 | 1.10 |
| 2800 | 3750 | 2750 | 2500 | 1.50 | 1.10 |

In the case of tubes A, C, E, F, G, and L, the exchange coefficient Hi was measured as a function of the head loss dP (Pa/m). The following table shows the Hi values for head losses of 14 KPa/m and 16 KPa/m.

| dP (KPa/m) | HiA | HiC | HiG | HiF | HiE | HiL |
|---|---|---|---|---|---|---|
| 14 | 3209 | 2777 | 2640 | 2300 | 2300 | 2300 |
| 16 | 3664 | 3300 | 3050 | 2936 | 2709 | 2709 |

The following table shows the ratios of the exchange coefficients, with the smooth tube L used as a reference.

| dP (KPa/m) | HiA/ HiL | HiC/ HiL | HiG/ HiL | HiF/ HiL | HiE/ HiL | HiL/ HiL |
|---|---|---|---|---|---|---|
| 14 | 1.395 | 1.21 | 1.15 | 1 | 1 | 1 |
| 16 | 1.35 | 1.22 | 1.13 | 1.08 | | 1 |

Thus, for a head loss of 14 KPa/m, compared to both the smooth tube L and the grooved tubes F and E of the type used in the current state of the art, tube A had a considerable weight savings of 39%.

For the tubes A and G according to the present invention, the influence of the helix angle was studied, with all other groove parameters being equal.

The following table shows the exchange coefficients and their ratios for identical head losses of 14 KPa/m and 18 KPa/m.

| dP (KPa/m) | HiA | HiG | HiA/HiG |
|---|---|---|---|
| 14 | 3239 | 2630 | 1.23 |
| 18 | 3674 | 3090 | 1.19 |

2) Tests at +5° C.:

The tests at +5° C. were performed on tubes A, B, C, E, F, and L. The exchange coefficient Hi was measured as a function of the head loss dP (Pa/m). The following table shows the Hi values for head losses of 4 KPa/m, 8 KPa/m, and 12 KPa/m.

| dP (KPa/m) | HiA | HiB | HiC | HiE | HiF | HiL |
|---|---|---|---|---|---|---|
| 4 | 2545 | 2273 | 1591 | 1591 | 1591 | 1591 |
| 8 | 4000 | 3545 | 2455 | 2273 | 2273 | 2273 |
| 12 | 4545 | 4409 | 3409 | 3045 | 2909 | 2773 |

The following table shows the ratios of the exchange coefficients, with the smooth tube L used as a reference.

| dP (KPa/m) | HiA/ HiL | HiB/ HiL | HiC/ HiL | HiE/ HiL | HiF/ HiL | HiL/ HiL |
|---|---|---|---|---|---|---|
| 4 | 1.60 | 1.43 | 1 | 1 | 1 | 1 |
| 8 | 1.76 | 1.47 | 1.08 | 1 | 1 | 1 |
| 12 | 1.64 | 1.59 | 1.23 | 1.10 | 1.05 | 1 |

B3) Tests with an Aqueous Solution of Potassium Formate

1) Tests at −5° C.

In the case of tubes A, B, C, E, F, and L, the exchange coefficient Hi was measured as a function of the head loss dP (Pa/m). The following table shows the Hi values for head losses of 4, 8, and 12 KPa/m.

| dP (KPa/m) | HiA | HiB | HiC | HiE | HiF | HiL |
|---|---|---|---|---|---|---|
| 4 | 2423 | 1769 | 1769 | 1769 | 1769 | 1769 |
| 8 | 3615 | 2615 | 3000 | 2615 | 2615 | 2615 |
| 12 | 4231 | 3539 | 4000 | 3269 | 3385 | 3077 |

The following table shows the ratios of the exchange coefficients, with the smooth tube L used as a reference.

| dP (KPa/m) | HiA/ HiL | HiB/ HiL | HiC/ HiL | HiE/ HiL | HiF/ HiL | HiL/ HiL |
|---|---|---|---|---|---|---|
| 4 | 1.37 | 1 | 1 | 1 | 1 | 1 |
| 8 | 1.38 | 1 | 1.15 | 1 | 1 | 1 |
| 12 | 1.38 | 1.15 | 1.30 | 1.06 | 1.10 | 1 |

2) Tests at +5° C.

In the case of tubes A, B, C, E, F, and L, the exchange coefficient Hi was measured as a function of the head loss dP (Pa/m). The following table shows the Hi values for head losses of 4, 8, and 12 KPa/m.

| dP (KPa/m) | HiA | HiB | HiC | HiE | HiF | HiL |
|---|---|---|---|---|---|---|
| 4 | 3256 | 2325 | 2791 | 2325 | 2325 | 2325 |
| 8 | 4000 | 3674 | 4280 | 3442 | 3674 | 3116 |
| 12 | 4744 | 4465 | 5000 | 4465 | 4465 | 3581 |

The following table shows the ratios of the exchange coefficients, with the smooth tube L used as a reference.

| dP (KPa/m) | HiA/ HiL | HiB/ HiL | HiC/ HiL | HiE/ HiL | HiF/ HiL | HiL/ HiL |
|---|---|---|---|---|---|---|
| 4 | 1.40 | 1 | 1.2 | 1 | 1 | 1 |
| 8 | 1.28 | 1.18 | 1.37 | 1.10 | 1.18 | 1 |
| 12 | 1.32 | 1.25 | 1.40 | 1.25 | 1.25 | 1 |

C) Conclusions

With every type of single-phase fluid studied and at every temperature used in the study, tube A had excellent performance and was extremely advantageous.

However, in particular cases, tubes B and C may be advantageous. For example, tube B may be advantageous in the case of heat exchange at +5° C. with an aqueous solution of monopropylene glycol used as the fluid circulating in the exchanger. Likewise, tube C may be advantageous in the case of heat exchange at +5° C. with an aqueous solution of K formate used as the fluid circulating in the exchanger.

Advantages of the Invention

The invention has great advantages. In effect, the invention provides high efficiency exchanger tubes for purposes of heat exchange, due to a very high exchange coefficient Hi.

Furthermore, it makes it possible to use tubes with a low weight per meter, since the tubes according to the present invention have both a small diameter and a low groove-bottom thickness. These tubes are very high performance with respect to the heat exchange coefficient and can replace tubes with a larger diameter and a thicker groove bottom. In addition, the relatively small number of ribs also makes for lighter tubes.

Finally, the tubes according to the present invention are particularly well suited to all heat exchanger circuits that use single-phase fluids, and particularly those that use aqueous solutions, which is a major practical advantage.

Figure Key

| | |
|---|---|
| Grooved tube | 1 |
| Rib | 2 |
| Groove | 3 |
| Axial groove | 30 |
| Battery | 4 |
| Fin | 5 |
| Tube axis | 6 |

What is claimed is:

1. A grooved metal tube comprising:

an arrangement having a groove-bottom thickness $T_f$ and an outside diameter De, for manufacture of heat exchangers which use one of a single-phase refrigerant and a coolant fluid, internally grooved by N helical ribs with an apex angle α, height H, base width $L_N$, and helix angle β, two consecutive ribs being separated by a groove, one of flat-bottomed and non-flat bottomed, having a width $L_R$, and a pitch P equal to $L_R+L_N$, wherein:

a) the value of thickness $T_f$ of the tube is such that $T_f$/De is equal to 0.023±0.005, wherein the values of $T_f$ and De are expressed in mm, with the value of De ranging between 4 and 14.5 mm;

b) the ribs have the value of height H such that H/De is equal to 0.028±0.005, wherein the values of H and De are expressed in mm;

c) the number N of ribs is such that N/De is equal to 2.1±0.4, and the value of the corresponding pitch P is equal to π·Di/N, with Di equal to De−2·$T_f$, and the value of De being expressed in mm;

d) the base widths $L_N$ and $L_R$ are such that $L_N/L_R$ is between 0.20 and 0.80;

e) the apex angle α ranges from 10° to 50°; and f) the helix angle β ranges from 20° to 50°;

so that a single-phase fluid, including one of water and glycol water, are used as one of a refrigerant and coolant fluid to ensure simultaneously a high heat exchange coefficient during heating and cooling, a low level of head loss and a low weight/meter.

2. The tube according to claim 1, wherein the helix angle β ranges from 25° to 35°.

3. The tube according to claim 1, wherein the apex angle α is between 15° and 30°.

4. The tube according to claim 1, wherein a S/H ratio (S being the surface between two consecutive grooves) is between 0.8 mm and 1.5 mm, and the values S and H are expressed in sq·mm and mm, respectively.

5. The tube according to claim 1, wherein H/De is equal to 0.028±0.003.

6. The tube according to claim 1, wherein P/H ranges from 3.5 to 7.

7. The tube according to claim 1, wherein the ribs have one of a triangular, trapezoidal, and quadrilateral cross-section, and one of rounded angles and non-rounded angles at a top of the rib.

8. The tube according to claim 7, wherein the ribs have a trapezoid profile with a base and a top, the top including a roughly flat central part, one of sloped and not sloped relative to the base, the top of the rib forming a small side of the trapezoid, one of with rounded edges and non rounded edges.

9. The tube according to claim 8, wherein at least one of the rounded top and the rounded edges have a radius of curvature of less than 100 μm, with a connection between the ribs and the flat bottoms having a radius of curvature of less than 100 μm.

10. The tube according to claim 1, wherein the ribs are symmetrical and connected to the flat bottoms with right and left connecting angles $\theta_1$ and $\theta_2$, such that $\theta_1$-$\theta_2$ is one of equal to and less than 10°, in order to form one of symmetrical and nearly symmetrical ribs.

11. The tube according to claim 1, wherein the ribs are connected to the flat bottoms with right and left connecting angles $\theta_1$ and $\theta_2$, such that $\theta_1$-$\theta_2$ is at least 10°, in order to form one of asymmetrical and inclined ribs.

12. The tube according to claim 1, wherein the ribs have a triangular-shaped base with a height $h_B$ and a trapezoidal-shaped top with a height $h_S$, with the value H equal to $h_B+h_S$ and $h_B/h_S$ ranging from 1 to 2.

13. The tube according to claim 1, wherein the ribs form a succession of ribs with a height H1=H and H2=a·H1, wherein the value of a is between 0.1 and 0.9, a rib with a height H1 being a primary rib and a rib with a height H2 being a secondary rib, the two ribs being separated by a flat-bottomed groove.

14. The tube according to claim 1, further comprising:

an axially grooved surface creating in the ribs notches with a typically triangular profile and a rounded top, the top having an angle γ ranging from 25 to 65°; wherein one of a lower part and top lies a distance h from a bottom of the grooves ranging from 0 to 0.2 mm.

15. The tube according to claim 1, wherein the tube is made of one of Cu and Cu alloys, Al and Al alloys, and Fe and Fe alloys.

16. The tube according to claim 1, wherein the tube is one of fluted and not fluted, and is one of produced by grooving the tubes and by flat-grooving a metal strip and then forming a welded tube.

17. The tube according to claim 1, wherein the tube has one of a round, oval, and rectangular cross-section.

18. A heat exchanger comprising:

an arrangement having tubes wherein the tubes have a groove bottom thickness $T_f$ and an outside diameter De, for manufacture of heat exchangers using one of a single-phase refrigerant and a coolant fluid, internally grooved by N helical ribs having an apex angle α, height H, base width $L_N$, and helix angle β, two consecutive ribs being separated by a groove, generally flat-bottomed, having a width $L_R$, and a pitch P equal to $L_R+L_N$, wherein:

a) the value of thickness $T_f$ of the tube is such that $T_f$/De is equal to 0.023±0.005, wherein the values of $T_f$ and De are expressed in mm, with the value of De ranging between 4 and 14.5 mm;

b) the ribs have the value of height H such that H/De is equal to 0.028±0.005, wherein the values of H and De are expressed in mm;

c) a number N of ribs is such that N/De is equal to 2.1±0.4, and the value of the corresponding pitch P is equal to n·Di/N, with Di equal to De−2·$T_f$, and the value of De being expressed in mm;

d) the base widths $L_N$ and $L_R$ are such that $L_N/L_R$ is between 0.20 and 0.80;

e) the apex angle α ranges from 10° to 50°; and f) the helix angle β ranges from 20° to 50°;

so that a single-phase fluid, including one of water and glycol water, are used as one of a refrigerant or coolant fluid to ensure simultaneously a high heat exchange coefficient during heating and cooling, a low level of head loss and a low weight/meter.

19. A method of using heat exchanger tubes, comprising:

passing a single phase fluid containing one of water, aqueous glycol solutioon containing 30% glycol, solutions of one of K formate and k acetate, slush, organic liquids and liquid $CO_2$ wherein the tube has a groove-bottom thickness $T_f$ and an outside diameter De, for manufacture of heat exchangers which use one of a single-phase refrigerant and a coolant fluid, internally grooved by N helical ribs with an apex angle α, height H, base width $L_N$, and helix angle β, two consecutive ribs being separated by a groove, one of flat-bottomed and non-flat bottomed, having a width $L_R$, and a pitch P equal to $L_R+L_N$, wherein:

a) the value of thickness $T_f$ of the tube is such that $T_f$/De is equal to 0.023±0.005, wherein the values of $T_f$ and De are expressed in mm, with the value of De ranging between 4 and 14.5 mm;

b) the ribs have the value of height H such that H/De is equal to 0.028±0.005, wherein the values of H and De are expressed in mm;

c) the number N of ribs is such that N/De is equal to 2.1±0.4, and the value of the corresponding pitch P is equal to π·Di/N, with Di equal to De−2·$T_f$, and the value of De being expressed in mm;

d) the base widths $L_N$ and $L_R$ are such that $L_N/L_R$ is between 0.20 and 0.80;

e) the apex angle α ranges from 10° to 50°; and f) the helix angle β ranges from 20° to 50°;

so that a single-phase fluid, including one of water and glycol water, are used as one of a refrigerant and coolant fluid to ensure simultaneously a high heat exchange coefficient during heating and cooling, a low level of head loss and a low weight/meter.

20. A method of using heat exchanger tubes, comprising:

passing a single phase fluid which as a dynamic viscosity between 0.5 and 30 mPa and a Prandtl number between 5 and 160 through a tube wherein the tube has a groove bottom thickness $T_f$ and an outside diameter De, for manufacture of heat exchangers which use one of a single-phase refrigerant and a coolant fluid, internally grooved by N helical ribs with an apex angle α, height H, base width $L_N$, and helix angle β, two consecutive ribs being separated by a groove, one of flat-bottomed and non-flat bottomed, having a width $L_R$, and a pitch P equal to $L_R+L_N$, wherein:

a) the value of thickness $T_f$ of the tube is such that $T_f$/De is equal to 0.023±0.005, wherein the values of $T_f$ and De are expressed in mm, with the value of De ranging between 4 and 14.5 mm;

b) the ribs have the value of height H such that H/De is equal to 0.028±0.005, wherein the values of H and De are expressed in mm;

c) the number N of ribs is such that N/De is equal to 2.1±0.4, and the value of the corresponding pitch P is equal to π·Di/N, with Di equal to De−2·$T_f$, and the value of De being expressed in mm;

d) the base widths $L_N$ and $L_R$ are such that $L_N/L_R$ is between 0.20 and 0.80;

e) the apex angle α ranges from 10° to 50°; and f) the helix angle β ranges from 20° to 50°;

so that a single-phase fluid, including one of water and glycol water, are used as one of a refrigerant and coolant fluid to ensure simultaneously a high heat exchange coefficient during heating and cooling, a low level of head loss and a low weight/meter.

* * * * *